US008016501B2

(12) United States Patent
Moriyama et al.

(10) Patent No.: US 8,016,501 B2
(45) Date of Patent: Sep. 13, 2011

(54) PRINTER AND PRINTING METHOD

(75) Inventors: Satoru Moriyama, Iwakura (JP); Naruhito Muto, Ama-gun (JP); Tomoki Miyashita, Nagoya (JP); Jun Jiang, Kyoto (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 1131 days.

(21) Appl. No.: 11/664,319

(22) PCT Filed: Aug. 5, 2005

(86) PCT No.: PCT/JP2005/014386
§ 371 (c)(1),
(2), (4) Date: Jun. 8, 2007

(87) PCT Pub. No.: WO2006/038374
PCT Pub. Date: Apr. 13, 2006

(65) Prior Publication Data

US 2007/0258748 A1 Nov. 8, 2007

(30) Foreign Application Priority Data

Sep. 30, 2004 (JP) ..... 2004-288501

(51) Int. Cl.
*B41J 11/66* (2006.01)

(52) U.S. Cl. ..... 400/621; 400/76

(58) Field of Classification Search ..... 400/621
See application file for complete search history.

(56) References Cited

U.S. PATENT DOCUMENTS

| | | | | |
|---|---|---|---|---|
| 3,614,306 | A * | 10/1971 | Goldberg et al. | 74/3.5 |
| 3,645,157 | A * | 2/1972 | Di Giulio et al. | 399/386 |
| 4,915,525 | A * | 4/1990 | Hosoi | 400/76 |
| 5,068,743 | A * | 11/1991 | Araki | 358/304 |
| 5,188,469 | A | 2/1993 | Nagao et al. | |
| 5,348,406 | A | 9/1994 | Yoshiaki et al. | |
| 5,419,648 | A | 5/1995 | Nagao et al. | |
| 5,447,383 | A * | 9/1995 | Hirono et al. | 400/621 |
| 5,458,423 | A * | 10/1995 | Sims et al. | 400/621 |
| 5,685,654 | A | 11/1997 | Nagao et al. | |
| 5,779,379 | A * | 7/1998 | Mason et al. | 400/621 |
| 6,164,854 | A * | 12/2000 | Otsuki | 400/621 |
| 6,287,030 | B1 * | 9/2001 | Furuya et al. | 400/61 |
| 6,644,873 | B2 * | 11/2003 | Kurashina | 400/621 |
| 6,663,303 | B2 * | 12/2003 | Horiuchi et al. | 400/61 |
| 2002/0090243 | A1 | 7/2002 | Hosokawa et al. | |

FOREIGN PATENT DOCUMENTS

| | | |
|---|---|---|
| EP | 1223043 A1 | 7/2002 |
| JP | 61-173978 | 8/1986 |
| JP | 02-106555 | 4/1990 |

(Continued)

*Primary Examiner* — Jill Culler
(74) *Attorney, Agent, or Firm* — Day Pitney LLP

(57) ABSTRACT

When a print tape (8) to be used as the label (25α) of a first sheet desired by one user is printed with no cut and then predetermined conditions, e.g. "time out elapse", are satisfied, the label (25α) is outputted from a printer (6) in a cut state. When the other user instructs the printer (6) to make another label by auto-cut, the other label is cut and outputted. Even if the one user instructs the printer (6) subsequently to make the label of a second sheet by auto-cut to make a label (25) where the label (25α) of the first sheet is connected with the label of the second sheet intentionally, the label of the second sheet is cut and outputted.

5 Claims, 11 Drawing Sheets

FOREIGN PATENT DOCUMENTS

| | | |
|---|---|---|
| JP | 06-091964 | 4/1994 |
| JP | 6-246987 | 9/1994 |
| JP | 7-61069 | 3/1995 |
| JP | 7-228015 | 8/1995 |
| JP | 7-228016 | 8/1995 |
| JP | 2003-001889 | 1/2003 |
| JP | 2003-246108 | 9/2003 |
| JP | 2004-050720 | 2/2004 |

* cited by examiner

PRINTER AND PRINTING METHOD

TECHNICAL FIELD

The present invention relates to a printer comprising a cutter for cutting a printing medium and a printing method.

BACKGROUND ART

Hitherto, there have been known a printer and a printing method for printing on a long sheet such as a roll sheet, comprising an auto-cut device for automatically producing one printed sheet by cutting off a printed part only from the long sheet. (See Patent Document 1)

[Patent Document 1] Japanese Patent Application laid-open No. H7 (1995)-228016.

Herein, when a user selects no-cut print mode to stop an operation of the auto-cut device, the printed sheet remains uncut. Therefore, if next printing is subsequently performed, the first and second printed sheets can be intentionally printed in a no-cut state.

DISCLOSURE OF THE INVENTION

Problem to be Solved by the Invention

However, a problem to be solved may arise when multiple users share the printer, in the case where one user intends to create a printed label where first and second sheets uncut, whereas another user executes a printing instruction just after the first sheet is printed in a no-cut mode, and the outputs by both of the users are printed on one sheet, which cannot be used as it is.

To be more specific, for instance, in the case where the one user intends to create one label where the first sheet and the second sheet are uncut while another user desires to create one label, if the label of the former user is printed prior to the label of the latter user, in a printer 6 shown in FIGS. 11A to 11C, a print tape 8 to be formed as a label 25α of the first sheet of the former user is firstly printed with no cut as shown in FIG. 11A, and a label 25β of the second sheet of the former user is printed as shown in FIG. 11B. Finally, a long label 25 automatically cut with the label 25α of the first sheet and the label 25β of the second sheet of the former user being uncut is discharged. Further, as shown in FIG. 11C, a label 25γ of the latter user is printed in a cut state in the printer 6. In the case of FIGS. 11A to 11C, the label 25 (FIG. 11B) desired by the former user, where the first and second sheets are uncut, and another label 25 (FIG. 11C) desired by the latter user are produced, thus both of the users can obtain the intended printed labels. This case can be also achieved when the label of the latter user is printed earlier than the label of the former user.

However, in the printer 6 shown in FIGS. 12A to 12C, when printing is executed by latter user immediately after the print tape 8 as the printed label 25α of the first sheet desired by the former user is printed in a no-cut mode, as shown in FIG. 12B, the printed label 25α of the former user and the printed label 25γ of latter user are printed in one sheet as a long label 25 being cut in an auto-cut mode, which cannot be used as it is. Incidentally, following this printing, when the former user intends to create the label 25 where the label 25α of the first sheet and the label 25β of the second sheet are uncut, the label 25β of the second sheet is printed in the cut state in the printer 6, as shown in FIG. 12C.

Accordingly, as shown in FIG. 12B, when the long label 25 where the label 25α and the label 25γ desired by the different users are uncut is printed being cut in the auto-cut mode, a trouble such as a loss of the printed label may occur under the situation where coordination between the users cannot be expected.

The present invention has been made in view of the above circumstances and has an object to overcome the above problems and to provide a printer and a printing method that reduce a risk of printing outputs by different users on one sheet with no cut.

Means for Solving the Problem

The present invention, which has been made for solving the problem, is characterized in that a printer comprising: print data storage means that stores inputted print data; print data printing means that prints the print data stored in the print data storage means on a printing medium; cutting means that cuts the printing medium printed by the print data printing means; cut-on mode setting means that sets the printer in a cut-on mode so that the cutting means is operated after the printing medium is printed by the print data printing means; and first-cut operation control means that operates the cutting means after the printing medium is printed by the print data printing means only when the cut-on mode setting means sets the printer in the cut-on mode, wherein the printer is provided with: determination means that determines whether a predetermined condition is met or not; and second-cut operation control means that, if the determination means determines that the predetermined condition is met, operates the cutting means after the printing medium is printed by the print data printing means even when the cut-on mode setting means does not set the printer in the cut-on mode.

The invention is characterized as comprising: clocking means that measures an elapsed time since the printing medium is last printed by the print data printing means, wherein the determination means determines that the predetermined condition is met when the elapsed time measured by the clocking means exceeds a set period of time.

The invention is characterized as comprising: a cover that is provided in a main body of the printer and is changeable between an opened state for allowing the printing medium printed by the print data printing means to be exposed and a closed state for covering the printing medium, and cover-state detection means that detects the opened state of the cover, wherein the determination means determines that the predetermined condition is met when the cover-state detection means detects the opened state of the cover.

The invention is characterized as comprising: a cover that is provided in a main body of the printer and is changeable between an opened state for allowing the printing medium printed by the print data printing means to be exposed and a closed state for covering the printing medium, and cover-motion detection means that detects a motion of the cover, wherein the determination means determines that the predetermined condition is met when the cover-motion determination means detects the motion of the cover.

The invention is characterized as comprising: the cover-motion detection means detects the motion of the cover when the cover is changed from the closed state to the opened state.

The invention is characterized as comprising: the cover-motion detection means detects the motion of the cover when the cover is changed from the opened state to the closed state.

The invention is characterized as comprising: a power supply that supplies power; and power detection means that detects power-on and power-off of the power supply, wherein the determination means determines that the predetermined condition is met when the power detection means detects the power-off of the power supply.

The invention is characterized as comprising: entry user information storage means that stores entry user information which includes a source of entry of the print data; and identification means that identifies whether or not entry user information newly stored in the entry user information storage means is different from entry user information last stored in the entry user information storage means, wherein the determination means determines that the predetermined condition is met when the identification means identifies the new entry user information as being different from the entry user information last stored in the entry user information storage means.

The invention is characterized as comprising: a connector, to which a cable for transfer of the print data can be removably connected; and cable detection means that detects whether the cable is inserted in or removed from the connector; wherein the determination means determines that the predetermined condition is met when the cable detection means detects the removal of the cable from the connector.

The invention is characterized as comprising: switching means that switches a cable for transfer of the print data to an on-line state or an off-line state; and switching operation detection means that detects an operation of the switching means, wherein the determination means determines that the predetermined condition is met when the switching operation detection means detects the operation of the switching means.

The present invention, which has been made for solving the problem, is characterized in that a printer comprising: a storage unit that stores inputted print data; a printing mechanism that prints the print data stored in the storage unit on a printing medium; a cutter device that cuts the printing medium printed by the printing mechanism; a cut-on mode setting device that sets the printer in a cut-on mode so that the cutter device is operated after the printing medium is printed by the printing mechanism; and a controller that operates the cutter device after the printing medium is printed by the printing mechanism only when the cut-on mode setting device sets the printer in the cut-on mode, wherein the controller further determines whether a predetermined condition is met or not, and if the controller determines that the predetermined condition is met, the controller operates the cutter device after the printing medium is printed by the printing mechanism even when the cut-on mode setting device does not set the printer in the cut-on mode.

The invention is characterized as wherein the controller further measures an elapsed time since the printing medium is last printed by the printing mechanism, and determines that the predetermined condition is met when the elapsed time being measured exceeds a set period of time.

The invention is characterized as comprising: a cover that is provided in a main body of the printer and is changeable between an opened state for allowing the printing medium printed by the printing mechanism to be exposed and a closed state for covering the printing medium, and a cover-state detection device that detects the opened state of the cover, wherein the controller determines that the predetermined condition is met when the cover-state detection device detects the opened state of the cover.

The invention is characterized as comprising: a cover that is provided in a main body of the printer and is changeable between an opened state for allowing the printing medium printed by the printing mechanism to be exposed and a closed state for covering the printing medium, and a cover-motion detection device that detects a motion of the cover, wherein the controller determines that the predetermined condition is met when the cover-motion determination device detects the motion of the cover.

The invention is characterized as wherein the controller further detects the motion of the cover when the cover is changed from the closed state to the opened state.

The invention is characterized as wherein the controller further detects the motion of the cover when the cover is changed from the opened state to the closed state.

The invention is characterized as further comprising: a power supply that supplies power; and a power detection device that detects power-on and power-off of the power supply, wherein the controller determines that the predetermined condition is met when the power detection device detects the power-off of the power supply.

The invention is characterized as wherein the storage unit stores entry user information which includes a source of entry of the print data, and the controller identifies whether or not entry user information newly stored in the storage unit is different from entry user information last stored in the storage unit, wherein the controller determines that the predetermined condition is met when the controller identifies the new entry user information as being different from the entry user information last stored in the storage unit.

The invention is characterized as wherein the controller detects whether a cable for transfer of the print data is inserted in or removed from a connector, to which the cable can be removably connected, and the controller determines that the predetermined condition is met when the controller detects the removal of the cable from the connector.

The invention is characterized as further comprising: a switching device that switches a cable for transfer of the print data to an on-line state or an off-line state; and wherein the controller determines that the predetermined condition is met when the controller detects the operation of the switching device.

The present invention which has been made for solving the problem, is characterized in that a printing method comprising: a storing step of storing inputted print data; a printing step of printing the print data stored in the storing step with a print mechanism; a cutting step of cutting the printing medium printed in the printing step with a cutter device; a cut-on mode setting step of setting a printer in a cut-on mode so that the cutter device is operated after the printing medium is printed in the printing step, and a first-cut operation controlling step of operating the cutter device after the printing medium is printed in the printing step only when the printer is set in the cut-on mode in the cut-on mode setting step, wherein the printing method further includes: a determination step of determining whether a predetermined condition is met or not; and a second-cut operation controlling step of, if it is determined that the predetermined condition is met, performing the cutting step after the printing medium is printed in the printing step even when the cut-on mode is not set in the cut-on mode setting step.

The invention is characterized as further comprising: a clocking step of measuring an elapsed time since the printing medium is last printed in the printing step, wherein it is determined that the predetermined condition is met in the determination step when the elapsed time measured in the clocking step exceeds a set period of time.

The invention is characterized as further comprising: a cover-state detection step of detecting an opened state of a cover which is provided in a main body of the printer and is changeable between the opened state for allowing the printing medium printed in the printing step to be exposed and a closed state for covering the printing medium, wherein it is determined that the predetermined condition is met in the determination step when the opened state of the cover is detected in the cover-state detection step.

The invention is characterized as further comprising: a cover-motion detection step of detecting a motion of a cover which is provided in a main body of the printer and is changeable between an opened state for allowing the printing medium printed in the printing step to be exposed and a closed state for covering the printing medium, wherein it is determined that the predetermined condition is met in the determination step when the motion of the cover is detected in the cover-motion detection step.

The invention is characterized as wherein it is determined that the predetermined condition is met in the cover-motion, detection step when the motion of the cover is detected when the cover is changed from the closed state to the opened state.

The invention is characterized as wherein it is determined that the predetermined condition is met in the cover-motion detection step when the motion of the cover is detected when the cover is changed from the opened state to the closed state.

The invention is characterized as further comprising: a power supplying step of supplying power to the power supply; and a power detection step of detecting power-on and power-off of the power supply, wherein it is determined that the predetermined condition is met in the determination detection step when the power-off of the power supply is detected in the power detection step.

The invention is characterized as wherein entry user information which includes a source of entry of the print data is stored in the storing step, and it is determined whether entry user information newly stored in the storing step is identified as being different from entry user information last stored or not in the determination step, and it is determined that the predetermined condition is met when the new entry user information is different from the entry user information last stored.

The invention is characterized as comprising: a cable detection step of detecting insertion in and removal from a connector, to which a cable for transfer of the print data can be removably connected, wherein it is determined that the predetermined condition is met when the removal of the cable from the connector is detected in the cable detection step.

The invention is characterized as comprising: a switching step of switching a cable for transfer of the print data to an on-line state or an off-line state; and a switching operation detection step of detecting an operation in the switching step; wherein it is determined that the predetermined condition is met when the operation in the switching step is detected in the switching operation detection step.

Effects of the Invention

Accordingly, the printer of the present invention has an advantage of cutting the printing medium in the case where it is determined that the predetermined condition is met even when the cut-on mode to cut the printing medium after printing is not set, which can reduce a possibility that outputs by different users are printed in the no-cut state.

The predetermined conditions include, in a view point of preventing the outputs by different users from being printed in the no-cut state, for instance, the condition that a predetermined time has elapsed after the last printing, the condition that the cover is opened, the condition that the cover is operated (from the closed state to the opened state, from the opened state to the closed state), the condition that the power is turned off, the condition that entry user information is changed, the condition that the communication cable is unconnected, and the condition that the state of the communication cable is switched (from the on-line state to the off-line state, the off-line state to the on-line state).

Further, a printing method of the present invention has an advantage of cutting the printing medium in the case where it is determined that the predetermined condition is met even when the cut-on mode to cut the printing medium after printing is not set, which can reduce a possibility that outputs by different users are printed uncut.

The predetermined conditions include, in a view point of preventing the outputs by different users from being printed uncut, for instance, the condition that a predetermined time has elapsed after the last printing, the condition that the cover is opened, the condition that the cover is operated (from the closed state to the opened state, from the opened state to the closed state), the condition that the power is turned off, the condition that entry user information is changed, the condition that the communication cable is unconnected, and the condition that the state of the communication cable is switched (from the on-line state to the off-line state, from the off-line state to the on-line state).

EXPLANATION OF REFERENCE NUMERAL

| | |
|---|---|
| 1 | Tape Printing Apparatus |
| 2A, 2B, 2C | Data Creating Apparatus |
| 4 | Keyboard |
| 6 | Printer |
| 7 | Cassette Cover |
| 8 | Print Tape |
| 25 | Label |
| 54 | CPU |
| 56 | RAM |
| 56a | Memory Area in RAM |
| 57 | Input/Output Interface (Input/Output I/F) |
| 66 | Movable Blade |
| 67 | Fixed Blade |
| 71 | DC Motor |
| 71A | Drive Shaft |
| 73 | Drive Circuit |
| 101 | Cover Sensor |
| 102 | Clock Circuit |
| 103 | Power Unit |
| 104 | Detection Circuit |
| 105 | Movable Blade Sensor |
| 201 | Connector |
| L | Connecting Cord |
| PM | Print Mechanism |

Best Mode for Carrying Out the Invention

A detailed description of a preferred embodiment of the present invention will now be given referring to the accompanying drawings. Firstly, a schematic structure of a tape printing apparatus according to this embodiment is explained.

Figure 7:
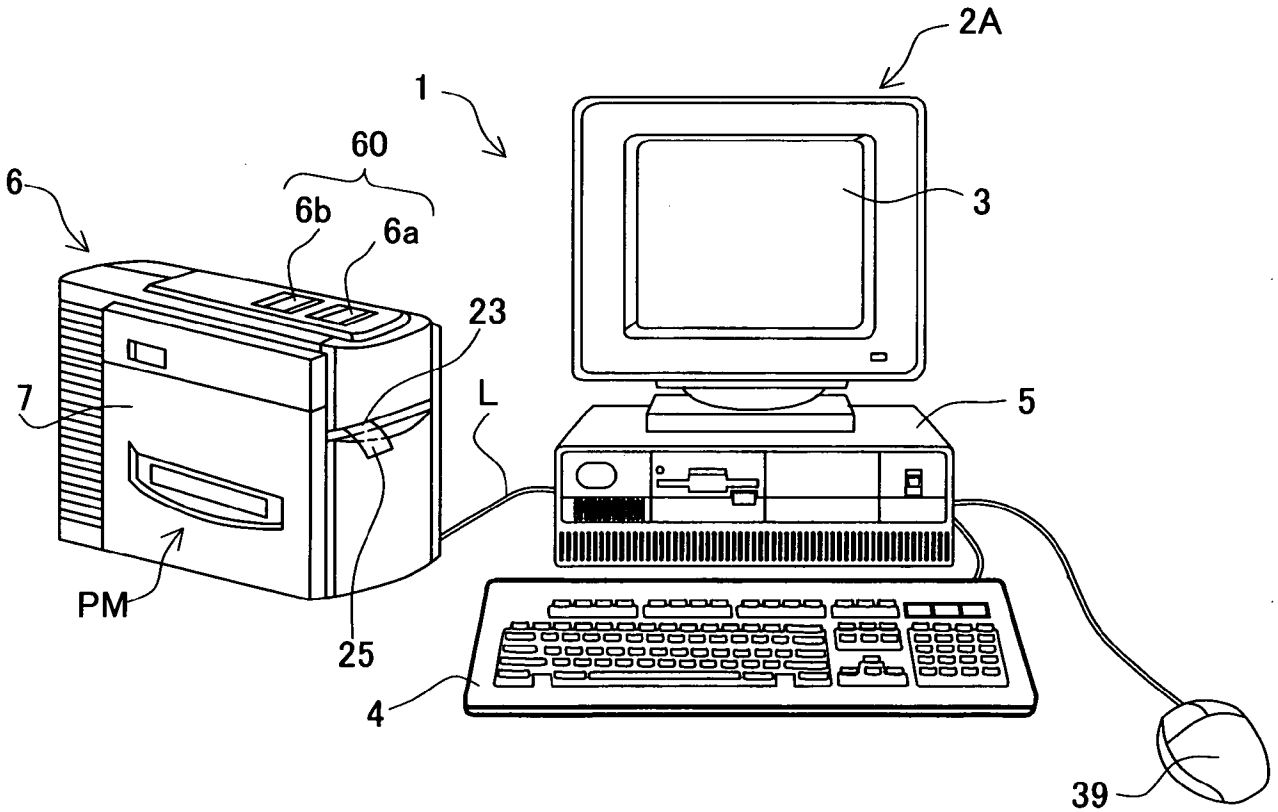
FIG. 7 is a perspective view of a tape printing apparatus.

As shown in FIG. 7, a tape printing apparatus 1 is composed of a data creating apparatus 2A comprising a CRT display 3 which can display a plurality of lines of characters, symbols and the like, a keyboard 4 and a control main unit 5, and a printer 6 connected to the control main unit 5 of the data creating apparatus 2A through a connecting cord L. Incidentally, the CRT display 3 and the keyboard 4 are connected to the control main unit 5 respectively through a connecting cord. Document data and various command signals expanded and processed in the data creating apparatus 2A are transferred to the printer 6 through the connecting cord L.

The keyboard 4 comprises a character key for entering alphabets, numbers, and symbols; a space key; a return key; cursor move keys for moving a cursor vertically and horizontally; a mode selection key for selecting a feed-cut process after printing; a size setting key for setting a size of print characters; a font setting key for setting a font of the print characters; various editing function keys; and a print key for executing printing.

The printer 6 also comprises, on a top face thereof, a key switch 60 including a power key 6*a* of the printer 6 and a function key (hereinafter, referred to as a "F key") 6*b* for executing the feed-cut of a print tape 8 and various operations such as printing. The feed-cut of this embodiment is an operation of feeding the print tape 8 by 25 mm, and then performing a tape cut. Further, a cassette cover 7 which can be opened/closed is provided on a side of the printer 6, and when the cassette cover 7 is opened, a tape storage cassette CS can be mounted on a print mechanism PM which will be described later.

Figure 8:
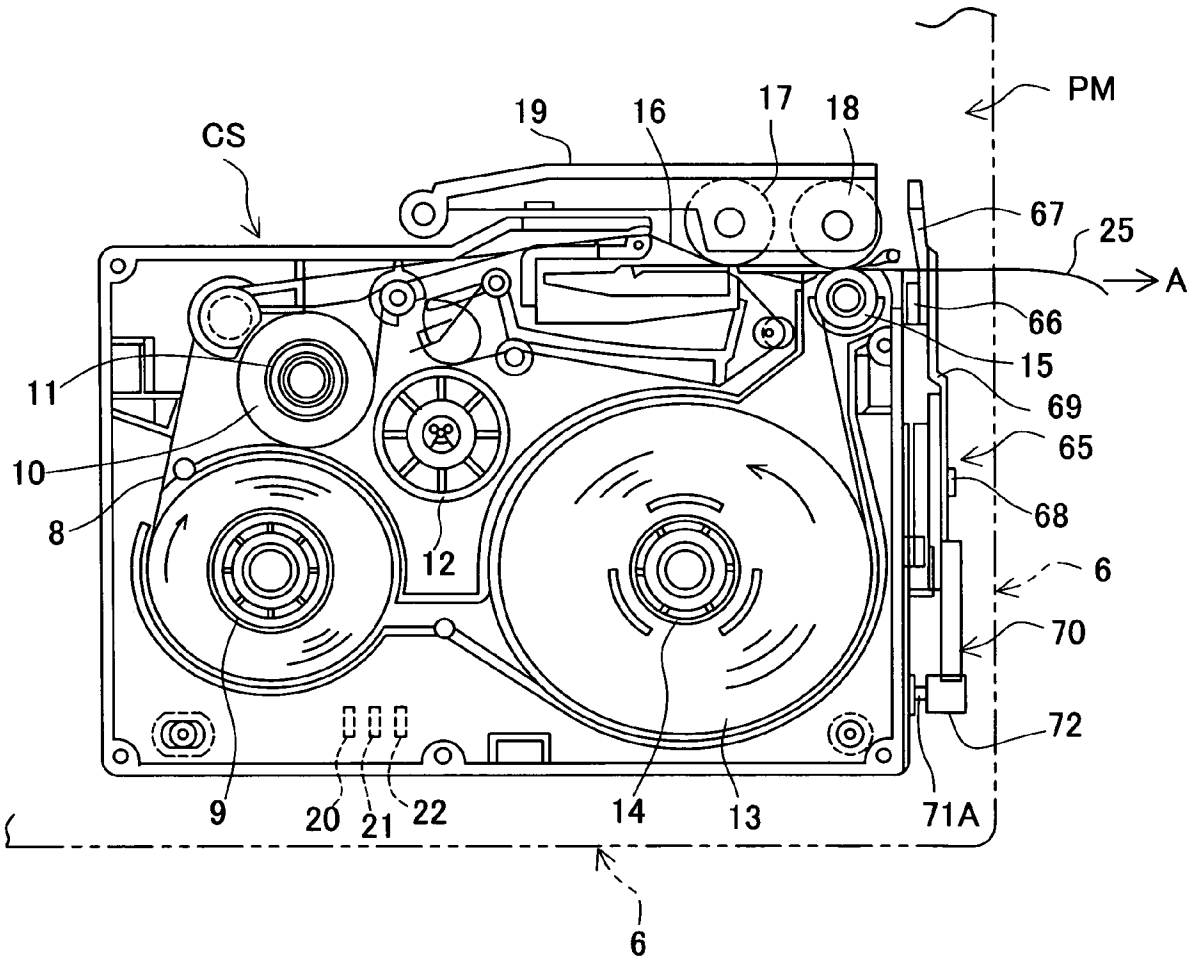
FIG. 8 is a schematic plan view of a print mechanism.

Next, the print mechanism PM built in the printer 6 is briefly explained with reference to FIG. 8. The rectangular tape storage cassette CS is removably mounted on the print mechanism PM, and in the tape storage cassette CS, there are rotatably provided a tape spool 9 on which the print tape 8 approximately 24 mm wide, made of a transparent film is wound, a ribbon supply spool 11 on which an ink ribbon 10 is wound, a take-up spool 12 which takes up the ink ribbon 10, a supply spool 14 on which a double-sided adhesive tape 13 having a same width as the print tape 8 is wound with a release paper outside, and a press roller 15 which adheres the print tape 8 to the double-sided adhesive tape 13.

A thermal head 16 is uprightly placed on a position where the print tape 8 and the ink ribbon 10 are brought to overlap each other. A platen roller 17 which presses the print tape 8 and the ink ribbon 10 against the thermal head 16, and a feed roller 18 which presses the print tape 8 and the double-sided adhesive tape 13 against the press roller 15 are turnably supported by a support body 19 which is pivotally provided in a frame of the printer 6. In the thermal head 16, a heating-elements group comprising one-hundred-and-twenty-eight heating elements are vertically provided in rows.

Figure 6:
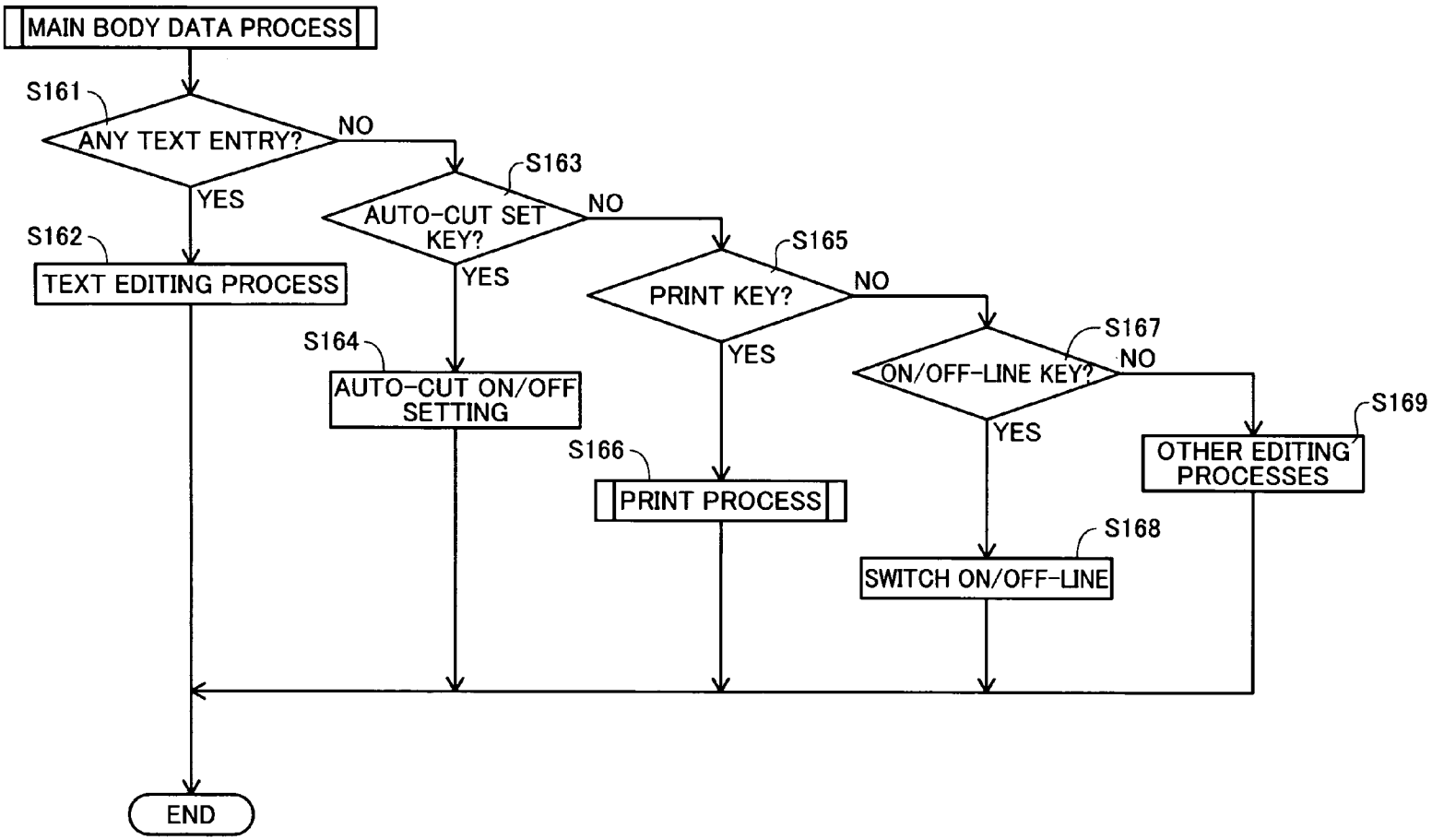
FIG. 6 is a flowchart of a main-body data process in the tape print process control in the printer.

Accordingly, when the heating-elements group is energized while the press roller 15 and the take-up spool 12 are synchronously rotated in each predetermined rotational direction in accordance with the rotation of a tape feed motor 50 (see FIG. 9) in a predetermined rotational direction, characters are printed on the print tape 8 with multiple dot lines, and the print tape 8 adhered to the double-sided adhesive tape 13 is further fed in a tape feeding direction A, and then discharged outside the printer 6 as shown in FIG. 6. It is noted that the print mechanism PM is substantially same as the publicly-known print mechanism disclosed in, for instance, the Japanese Patent Application laid-open No. H02 (1990)-106555, and thus the detailed explanation thereof is herein omitted.

As the tape storage cassettes CS, cassettes CS are available in five types, each of which stores one of the print tapes 8 of 6 mm, 9 mm, 12 mm, 18 mm and 24 mm in width. On a bottom face of those respective tape storage cassettes CS, first through third protrusion tabs 20-22 are provided alone or in combination. On the frame of the printer 6, there is provided a tape width sensor 53 (see FIG. 9) composed of a photo interrupter for detecting the presence or the absence of the respective first through third protrusion tabs 20-22.

A cutter device 65 is arranged in the proximity of a label discharging slot 23 on the downstream side of the thermal head 16 in a feeding direction of the print tape 8. The cutter device 65 is formed in a same configuration as publicly-known scissors, and composed of a fixed blade 66 and a movable blade 67. The movable blade 67 is fixed to a turning lever 69 turning about a pivot 68, and the turning lever 69 is coupled to a pinion 72 affixed on a drive shaft 71A of a DC motor 71 by way of a gear device 70.

Accordingly, the movable blade 67 is opened or closed about the pivot 68 by way of the pinion 72, the gear device 70, and the turning lever 69 along with normal and reverse rotation of the drive shaft 71A of the DC motor 71, and cuts off a produced label 25 in cooperation with the fixed blade 66 in the opening and closing action. A distance between a printing position by the thermal head 16 and a cutting position by the cutter device 65 is a distance n, which is referred to as a head-cutter distance n. In this embodiment, n is equal to 25 mm.

Figure 9:
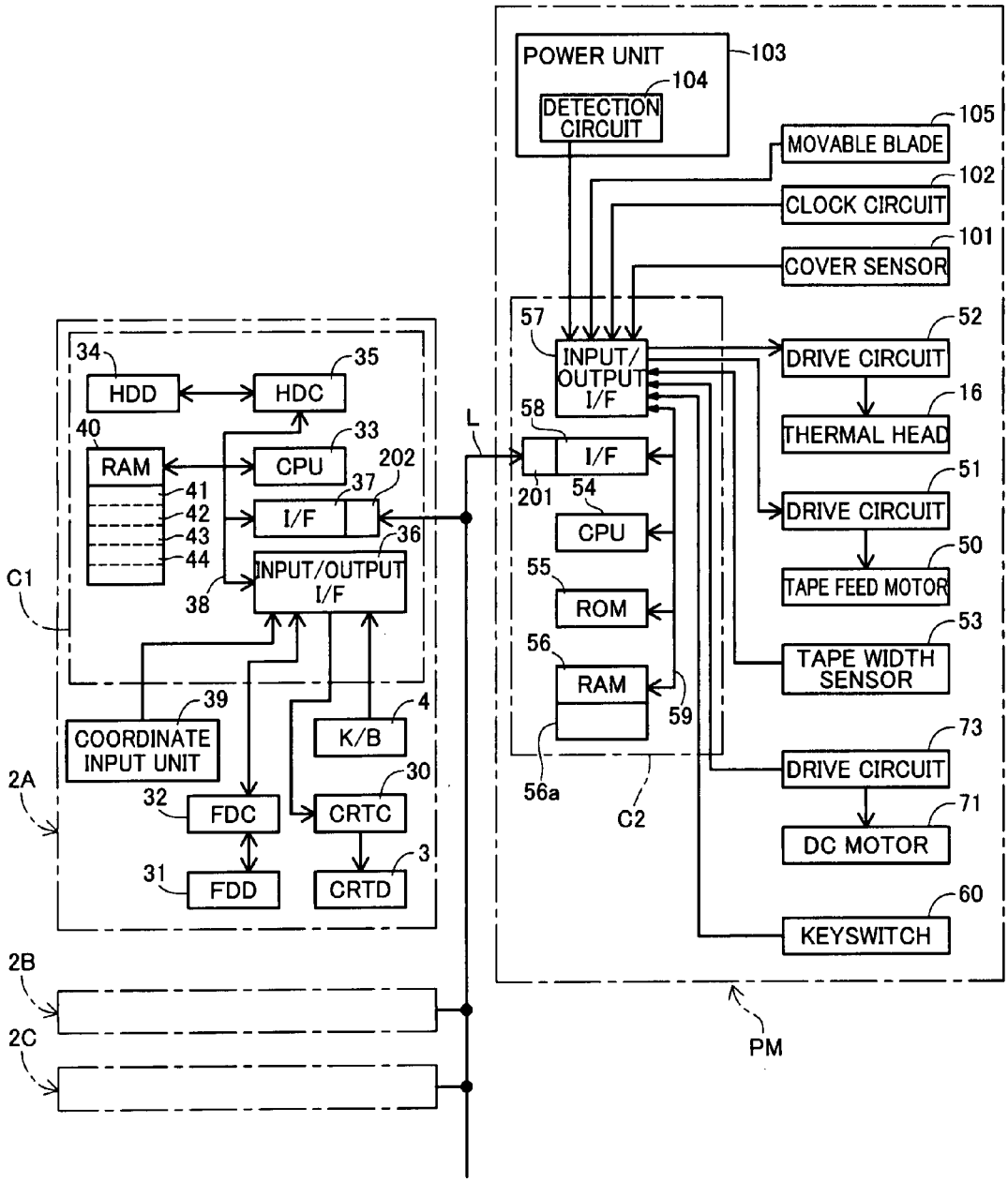
FIG. 9 is a block diagram of a control system of the tape printing apparatus.

A following-described control system of the tape printing apparatus 1 is configured as shown in a block diagram of FIG. 9.

Firstly, a control system of the data creating apparatus 2A is explained. The keyboard (K/B) 4, a CRT display controller (CRTC) 30 having a display RAM for outputting display data to the CRT display (CRTD) 3, a Floppy™ disc drive controller (FDC) 32 for a Floppy™ disc drive (FDD) 31, provided in the control main unit 5, and a coordinate input unit 39 are respectively connected to an input/output interface (input/output I/F) 36 of a control unit C1 provided in the control main unit 5.

The control unit C1 comprises a CPU 33, the input/output interface 36 connected to the CPU 33 via a bus 38 such as a data bus, a communication interface (I/F) 37, a hard disc drive controller (HDC) 35 for a hard disc drive unit (HDD) 34 into which a hard disc is inserted, and a RAM 40. Further, a connector 202 of which a socket is exposed on an outer side of the control main unit 5 is provided in the communication interface (I/F) 37, and the connecting cord L can be connected to the connector 202.

The hard disc stores: display pattern data memory which holds display dot pattern data corresponding to code data, related to individual large numbers of the characters; font memory which holds outline data for defining outlines of the individual large numbers of the characters to be printed, classified in units of a typeface (Gothic typeface, Mincho typeface, or the like) in correlation to the code data; a display drive control program which controls the CRT display controller 30 in correlation to the code data of the characters such as letters, numbers and symbols entered with the keyboard 4; and an image expanding control program which transfers the outline data corresponding to the code data in text memory 41 of the RAM 40, to the dot pattern data and outputs the dot pattern data to the printer 6.

The text memory 41 of the RAM 40 stores the document data entered with the keyboard 4. Print format memory 42 stores a plurality types of print format data such as data of font size and data of font number which have been set. Print buffer 43 stores print dot pattern data of letters and symbols which have been expanded and processed as image data. Work memory 44 temporarily stores data which is necessary for data processing.

Next, a control system of the printer 6 is explained. A drive circuit 52 for driving the thermal head 16, a drive circuit 51 for driving the tape feed motor 50, a drive circuit 73 for driving the DC motor 71, the tape width sensor 53 and the key switch 60 are respectively connected to an input/output interface (input/output I/F) 57 of a control unit C2.

The control unit C2 is composed of a CPU 54, the input/output interface (input/output I/F) 57 connected to the CPU 54 via a bus 59 such as a data bus, a communication interface (I/F) 58, a ROM 55 and a RAM 56. Further, a connector 201 of which a socket is exposed on an outer side of the printer 6 is provided in the communication interface (I/F) 58, and the connecting cord L can be connected to the connector 201.

The ROM 55 stores programs such as a print drive control program to drive the thermal head 16 and the tape feed motor 50 and the like on the basis of the dot pattern data transferred from the data creating apparatus 2A and a program to control each device following the command by the data creating device 2A or the key switch 60.

The RAM 56 comprises various types of memory for temporarily storing results calculated in the CPU 54, flags and pointers for showing a status of operations of each part. Especially, the RAM 56 is provided with a memory area 56*a* where entry user information is overwritten.

To the input/output interface (input/output I/F) 57 of the control unit C2, a cover sensor 101, a clock circuit 102*a*, a power unit 103 and a movable blade sensor 105 are respectively connected. Herein, the cover sensor 101 is a sensor which can detect an opened/closed state of the cassette cover 7 of the printer 6. The power unit 103 comprises a detection circuit 104 which can detect an on/off state of the power. The movable blade sensor 105 is a detection circuit which can detect an operation of the movable blade 67 and determine whether the label 25 has been cut or not.

The input/output interface (input/output I/F) 57 of the control unit C2 is connected not only to the data creating apparatus 2A via the connecting cord L connected to the connector 201, but also to other data creating apparatuses 2B, 2C and more, which constitute a local-area network. The data creating apparatus 2B, 2C and more have same functions as the data creating apparatus 2A with respect to the printer 6.

Next, a routine of a tape print control performed in the control unit C2 of the printer 6 is explained with reference to FIG. 1 and a schematic flowchart of FIG. 6.

Figure 1:
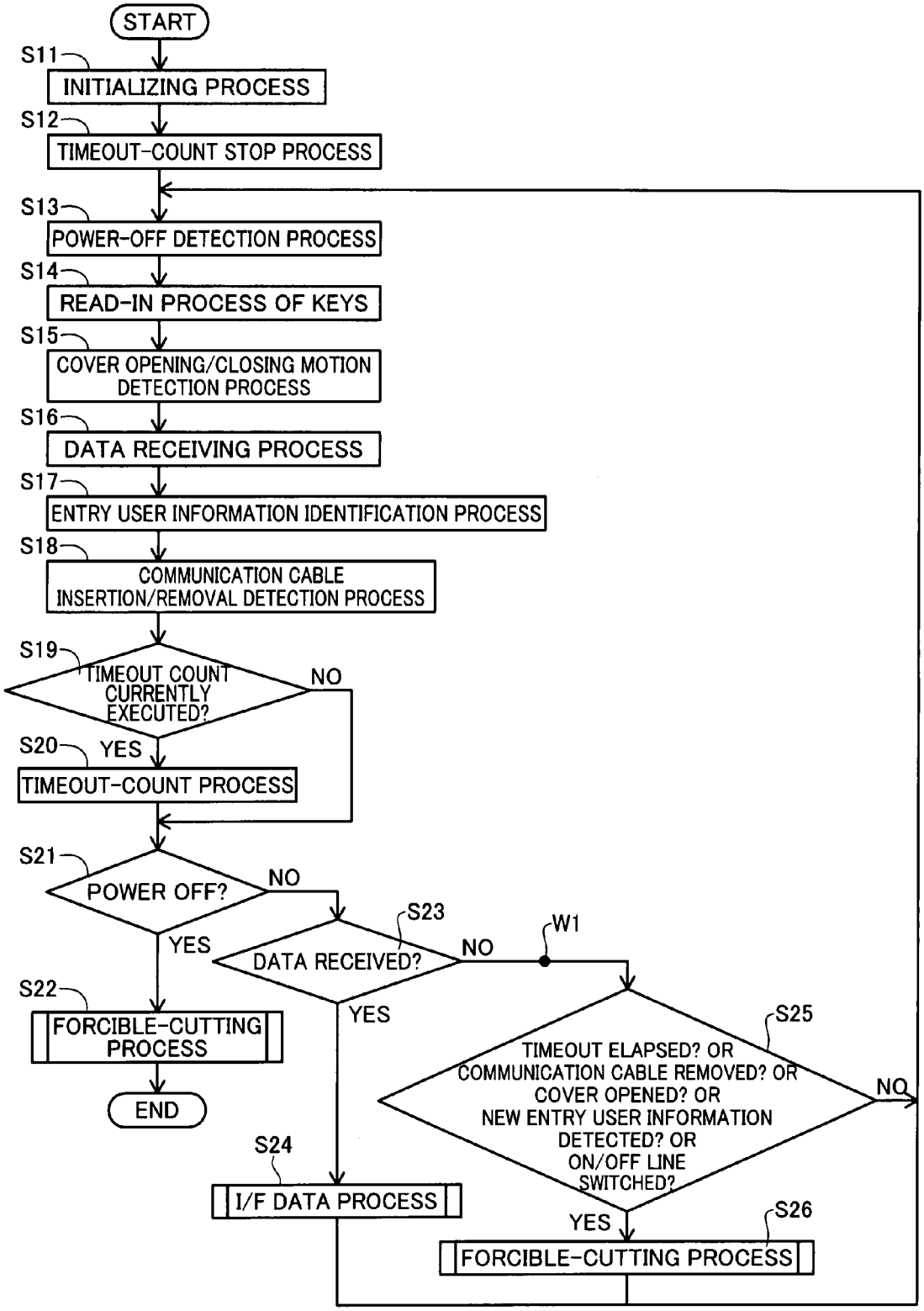
FIG. 1 is a flowchart of a tape print process control in a printer.

The tape print control performed in the control unit C2 of the printer 6 starts with an initializing process at S11 in FIG. 1, and then proceeds to a timeout-count stop process at S12. The control unit C2 of the printer 6 comprises a timer (not shown) in which a counter is incremented as the time passes. This timer is used as a timer for the timeout. How much time is elapsed is determined by the periodic comparison of a value of the timer with a predetermined value. At S12, the timer which is not shown is stopped.

Further, at S13, a power-off detection process is executed by the detection circuit 104 of the power unit 103, and then the detection result is stored in the RAM 56. At S14, a read-in process of keys entered with the keyboard 4, and then the input result is stored in the RAM 56.

At S15, a cover opening/closing motion detection process is executed by the cover sensor 101, and then the detection result is stored in the RAM 56. At S16, a data receiving process is executed, and then the data received through the input/output interface (input/output I/F) 57 is stored in the RAM 56.

Further, at S17, an entry user information identification process is executed, and the entry user information which is identified in this process is stored in the storage area 56*a* of the RAM 56. Incidentally, the entry user information is the data which is added to the print data transferred from the data creating apparatuses 2A, 2B, 2C and more through the input/output interface (input/output I/F) 57, and with which a source of the print data can be identified. Further, at S18, a communication cable insertion/removal detection process is executed by the input/output interface (input/output I/F) 57, and then a connecting state of the connecting cord L which is connected to the input/output interface (input/output I/F) 57 is stored in the RAM 56.

At S19, it is determined whether a timeout count is currently executed or not. If it is determined that the timeout count is not currently executed (S19: NO), the flow advances to S21 without any more processes. On the other hand, if it is determined that the time count is currently executed (S19: YES), the flow advances to S20 to execute the timeout-count process by the clock circuit 102, measuring the time, and then further advances to S21.

At S21, it is determined whether the power is off or not. This determination is executed on the basis of the data stored in the RAM 56 in the above-described power-off detection process at S13. If it is determined that the power is off (S21: YES), the flow advances to S22 to execute a forcible-cutting process in FIG. 2, which will be explained later, and then the routine of the tape print control is terminated. On the other hand, if it is determined that the power is not off (S21: NO), the flow advances to S23.

At S23, it is determined whether there is the data received or not. This determination is made on the basis of the data stored in the RAM 56 in the data receiving process at S16. If it is determined that there is the data received (S23: YES), the flow advances to S24 to execute the I/F data process in FIG. 2, which will be described later, and then the flow returns to S13 to repeat the processes described above. On the other hand, if it is determined that there is no data received (S23: NO), the flow advances to S25.

At S25, it is determined whether a predetermined condition is met. Herein, it can be said that the predetermined condition is met when any one of conditions such as "timeout elapsed", "communication cable removed", "cover opened", "new entry user information detected" and "on/off line switched" is met.

With regard to the "timeout elapsed", the predetermined condition is met when a predetermined time (for instance, 3 minutes) has passed in the timeout-count process by the clock circuit 102 at S20 as above. With regard to the "communication cable removed", the predetermined condition is met when the connecting cord L is removed from the input/output interface (input/output I/F) 57, which is determined on the basis of the data stored in the RAM 56 in the communication cable insertion/removal detection process at S18 as above. With regard to the "cover opened", the predetermined condition is met when the cassette cover 7 of the printer 6 is opened, which is determined on the basis of the data stored in the RAM 56 in the cover opening/closing motion detection process at S15 as above. With regard to the "new entry user information detected", the predetermined condition is met when the entry user information added to the print data which is transferred from the data creating apparatuses 2A, 2B, 2C and more through the input/output interface (input/output I/F) 57 is new, which is determined on the basis of the data stored in the storage area 56*a* of the RAM 56 in the entry user information identification process at S17 as above. With regard to the "on/off line switched", the predetermined condition is met when the connecting cord L connected to the input/output interface (input/output I/F) 57 is switched from the on-line state to the off-line state, or from the off-line state to the on-line state, which is determined on the basis of the data stored in the RAM 56 in the data receiving process at S16 as above, more specifically, it is determined that the predetermined condition is met when the data newly stored in the RAM 56 includes the on-line/off-line command data.

At S25, if the predetermined condition is met (S25: YES), the flow advances to S26 to execute the forcible-cutting process in FIG. 2, which will be explained later, and then the flow returns to S13 to repeat the processes described above. On the other hand, if the predetermined condition is not matched (S25: NO), the process returns to S13 without any more processes to repeat the processes described above.

Figure 2:
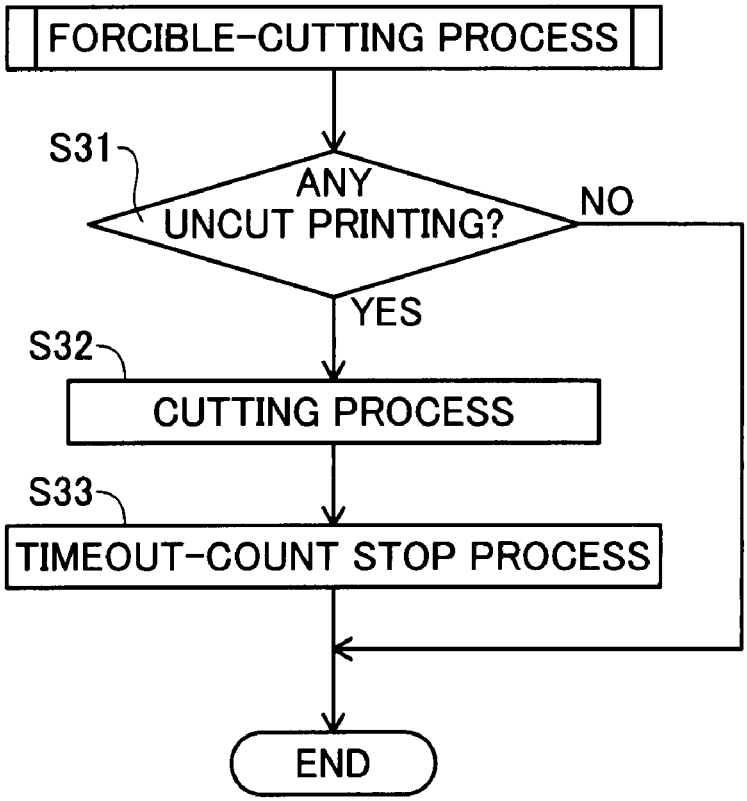
FIG. 2 is a flowchart of a forcible-cutting process in the tape print process control in the printer.

Next, the forcible-cutting process at above-described S22 and S26 is explained with reference to FIG. 2. In the forcible-cutting process as shown in FIG. 2, first it is determined whether any uncut printing remains or not at S31. This determination is made on the basis of a value of an uncut flag (not shown) of the RAM 40. Herein, if it is determined that there is no uncut printing any more (S31: NO), the forcible-cutting process is terminated without any more processes, whereas the flow advances to S32 if it is determined that the uncut printing still remains (S31: YES). It is noted that the uncut flag (not shown) is set to ON when one label is printed, and is set to OFF when the label is cut.

At S32, a cutting process is executed to cut off the label 25 from the print tape 8 with the movable blade 67 which is turned normally and reversely along with the normal and reverse rotation of the drive shaft 71A of the DC motor 71, in cooperation with the fixed blade 66. At this time, the uncut flag (not shown) is set to OFF.

Further, the flow advances to S33 at which the timeout-count stop process is executed to reset the timeout-count process by the clock circuit 102, and then the forcible-cutting process is terminated.

Figure 3:
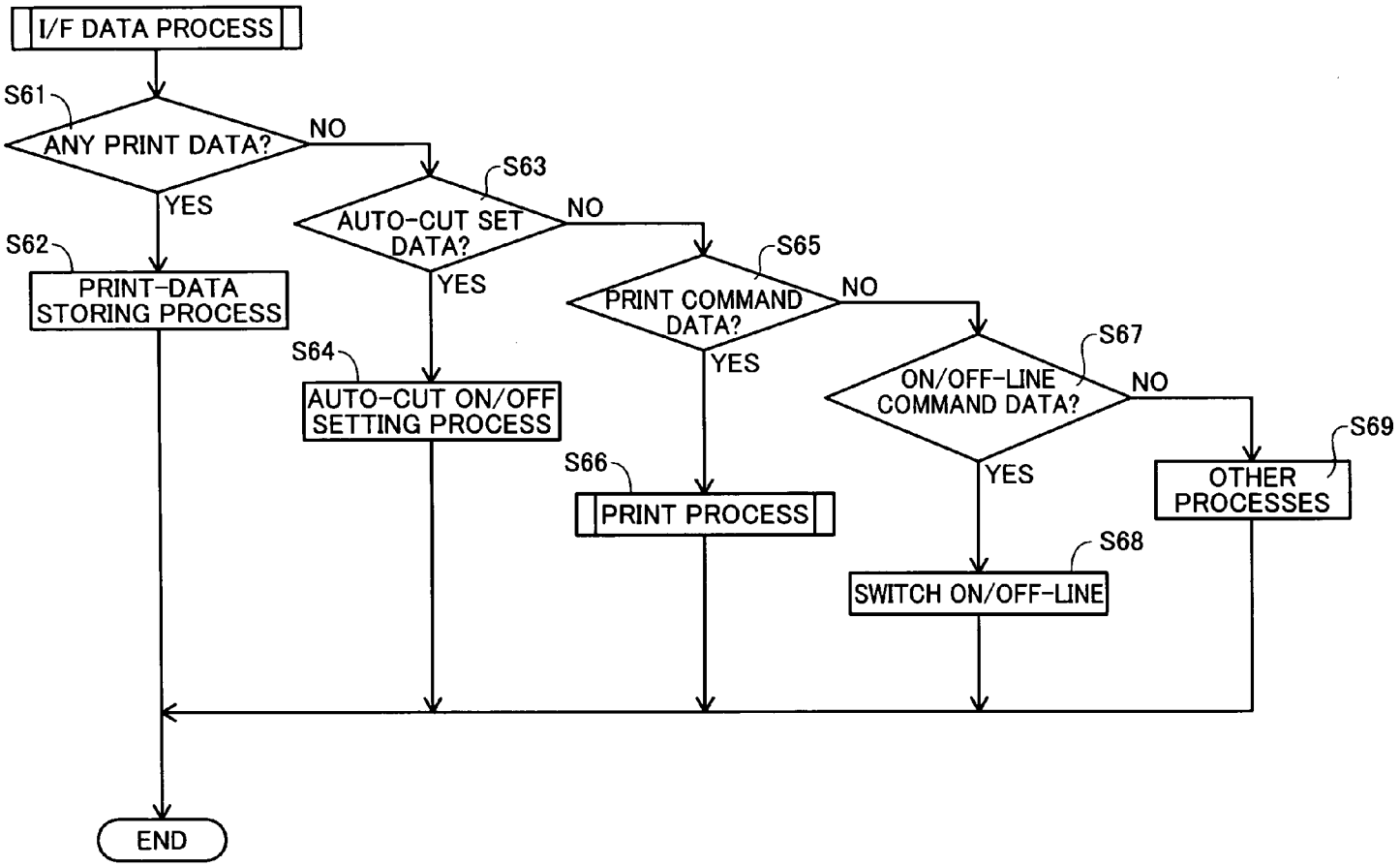
FIG. 3 is a flowchart of an I/F data process in the tape print process control in the printer.

Next, the above-described I/F data process at S24 is explained with reference to FIG. 3. In the I/F data process as shown in FIG. 3, first it is determined whether the data stored in the RAM 56 in the above-described data receiving process at S16 is the print data or not at S61. Herein, if it is determined that the data stored in the RAM 56 in the data receiving process is the print data (S61: YES), the flow advances to S62 to execute a print-data storing process of buffering the print data to be printed on the label 25 in the RAM 56, and then the I/F data process is terminated. On the other hand, if it is determined that the data stored in the RAM 56 in the above-described data receiving process at S16 is not the print data (S61: NO), the flow advances to S63.

At S63, it is determined whether the data stored in the RAM 56 in the above-described data receiving process at S16 is auto-cut set data or not. Herein, if it is determined that the data stored in the RAM 56 in the above-described data receiving process at S16 is the auto-cut set data (S63: YES), the flow advances to S64 to execute an auto-cut on/off setting process, and then the I/F data process is terminated after the setting is stored in the RAM 56. On the other hand, if it is determined that the data stored in the RAM 56 in the above-described data receiving process at S16 is not the auto-cut set data (S63: NO), the flow advances to S65.

At S65, it is determined whether the data stored in the RAM 56 in the above-described data receiving process at S16 is print command data or not. Herein, if it is determined that the data stored in the RAM 56 in the above-described data receiving process at S16 is the print command data (S65: YES), the flow advances to S66 to execute a print process in FIG. 4, which will be described later, and then the I/F data process is terminated. On the other hand, if it is determined that the data stored in the RAM 56 in the above-described data receiving process at S16 is not the print command data (S65: NO), the flow advances to S67.

At S67, it is determined whether the on-line/off-line command data is newly stored in the RAM 56 at the above-described data receiving process at S16 or not. Herein, it is determined that the on-line/off-line command data is newly stored in the RAM 56 at the above-described data receiving process at S16 (S67: YES), the flow advances to S68 to switch the connecting cord L connected to the input/output interface (input/output I/F) 57 to the off-line state from the on-line state, or to the on-line state from the off-line state, and then the I/F data process is terminated. On the other hand, if it is determined that the on-line/off-line command data is not newly stored in the RAM 56 at the above-described data receiving process at S16 (S67: NO), the flow advances to S69 to execute other processes, and then the I/F data process is terminated.

Figure 4:
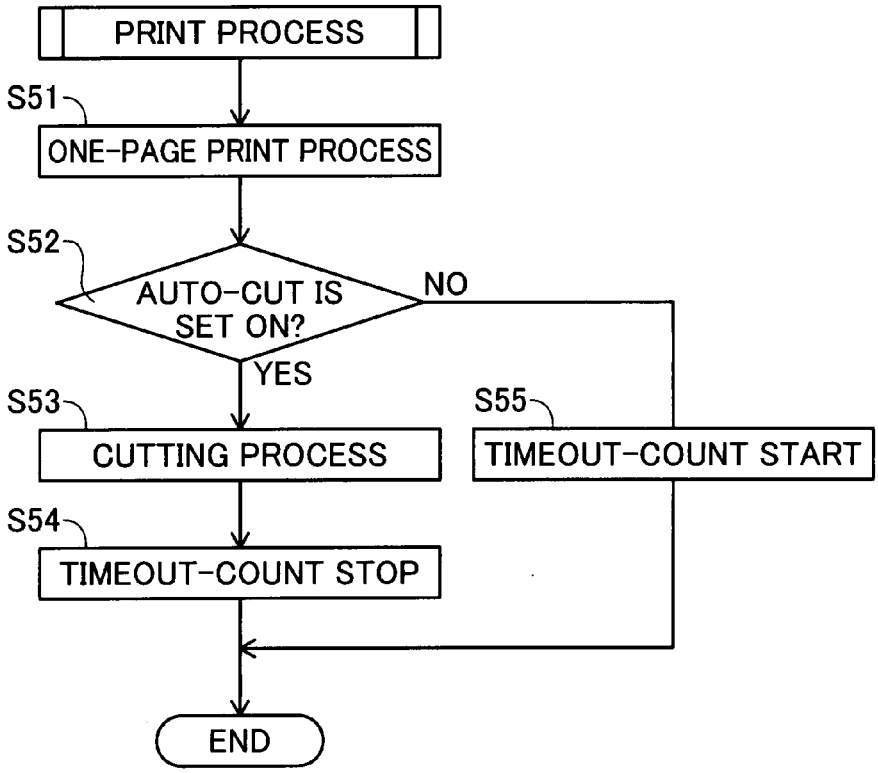
FIG. 4 is a flowchart of a print process in the tape print process control in the printer.
Figure 5:
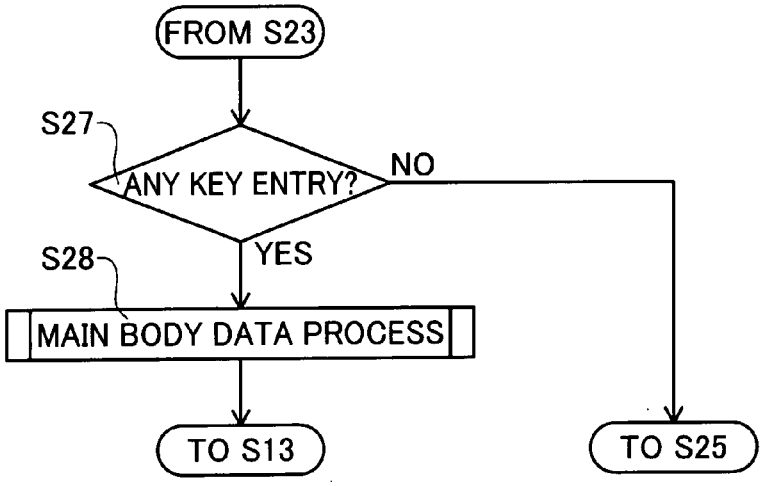
FIG. 5 is a flowchart of the tape print process control in the printer.

Next, the above-described print process at S66 is explained with reference to FIG. 4. In the print process as shown in FIG. 4, first one-page print process is executed to print the print data stored in the RAM 56 by one page on the print tape 8 with the print mechanism PM at S51. At this time, the uncut flag (not shown) of the RAM 40 is set to ON. After that, the flow advances to S52.

At S52, it is determined whether the auto-cut is set to ON or not. Herein, if it is determined that the auto-cut is set to ON (S52: YES), the flow advances to S53 to execute a cutting process to cut the label 25 from the print tape 8 by turning the movable blade 67 normally and reversely along with the normal and reverse rotation of the drive shaft 71A of the DC motor 71, in cooperation with the fixed blade 66. At this time, the uncut flag (not shown) of the RAM 40 is set to OFF.

At S54, the timeout-count stop process is executed to stop the timeout-count process by the clock circuit 102, and then the print process is terminated.

On the other hand, if it is determined that the auto-cut is set to OFF (S52: NO), the flow advances to S55 to start the timeout-count process, and then the print process is terminated.

Figure 10A:
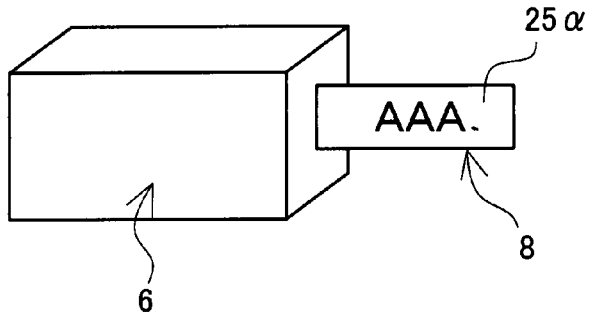
FIG. 10A is a diagram showing an example of prevention when different users share the tape printing apparatus.
Figure 10B:
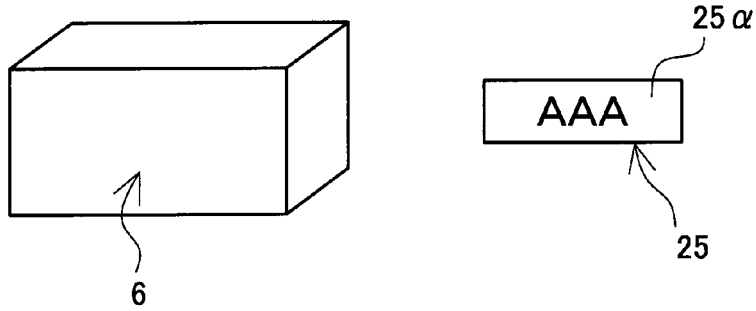
FIG. 10B is a diagram showing an example of prevention when different users share the tape printing apparatus.

As described in detail above, in the tape printing apparatus 1 of this embodiment, if one user intends to create the label 25 where the first sheet and the second sheet are uncut by using the data creating apparatus 2A while another user tries to create the label 25 of one sheet by using the data creating apparatus 2B, when the former user issues the command to create the label 25α of the first sheet in the no-cut mode to the printer 6 using the data creating apparatus 2A (S52: NO), the print tape 8 is printed as the label 25α of the first sheet desired by the former user in the no-cut state, and then if any one of the conditions such as "timeout elapsed", "communication cable removed", "cover opened", "new entry user information detected" and "on/off line switched" is matched (S25: YES), the label 25α of the first sheet desired by the former user is discharged in the cut state from the printer 6 as shown in FIG. 10B. (S26, S32).

Figure 10C:
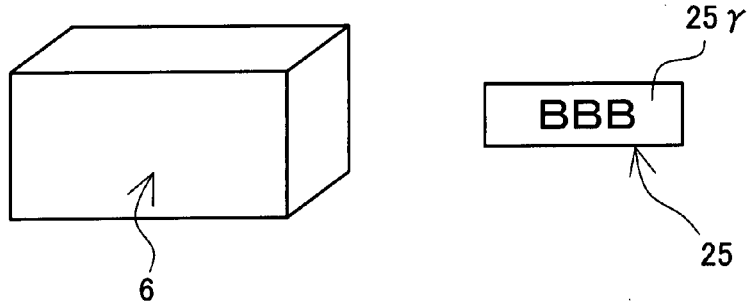
FIG. 10C is a diagram showing an example of prevention when different users share the tape printing apparatus.

At this time, the latter user issues a command to create the label 25 of one sheet to the printer 6 by using the data creating apparatus 2B by the auto-cut (S52: YES), the label 25γ desired by the latter user is discharged in the auto-cut state as shown in the printer 6 in FIG. 10C.

Figure 10D:
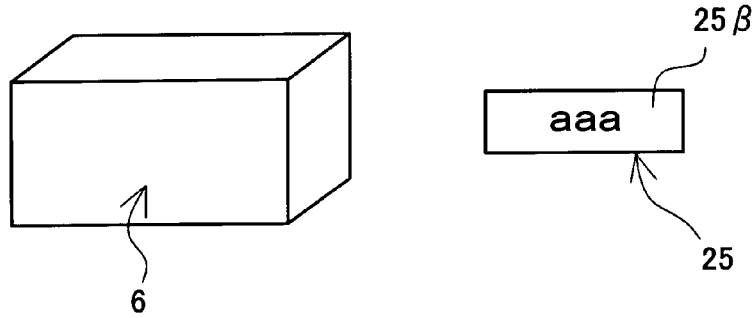
FIG. 10D is a diagram showing an example of prevention when different users share the tape printing apparatus.
Figure 11A:
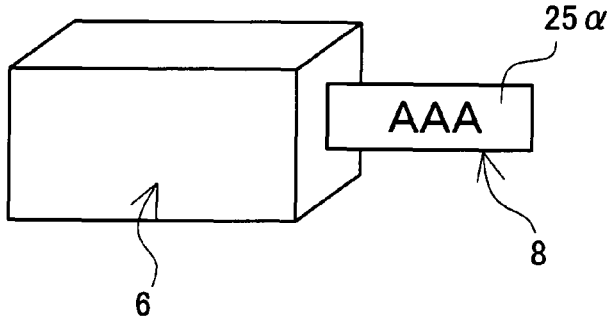
FIG. 11A is a diagram showing an example of success when different users share the tape printing apparatus.
Figure 11B:
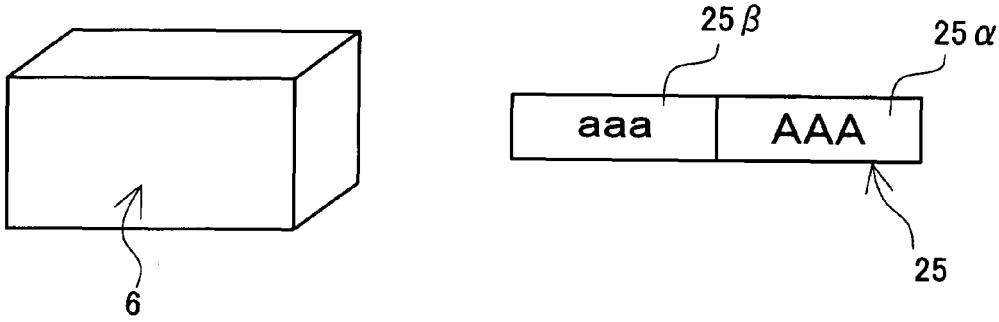
FIG. 11B is a diagram showing an example of success when different users share the tape printing apparatus.
Figure 11C:
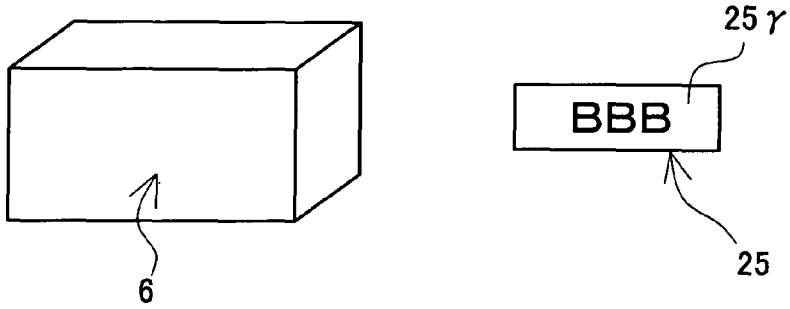
FIG. 11C is a diagram showing an example of success when different users share the tape printing apparatus.

Subsequently, the former user issues a command to create the label 25β of the second sheet to the printer 6 by using the data creating apparatus 2A by the auto-cut (S52: YES), one sheet of the label 25β desired by the former user is discharged in the auto-cut state as shown in the printer 6 in FIG. 10D, even though the former user intends to create the label 25 where the label 25α of the first sheet and the label 25β of the second sheet are uncut by using the data creating apparatus 2A.

Figure 12A:
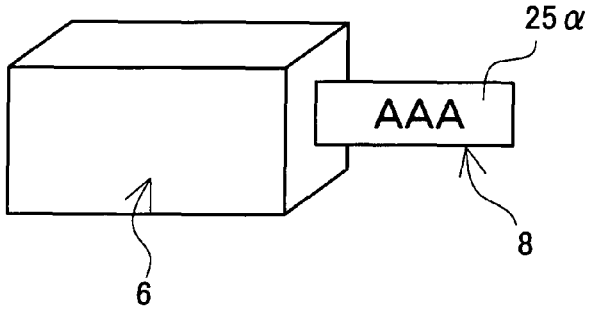
FIG. 12A is a diagram showing an example of failure when different users share the tape printing apparatus.
Figure 12B:
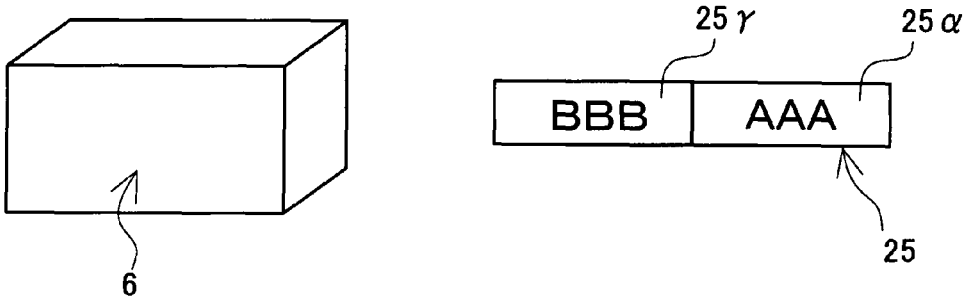
FIG. 12B is a diagram showing an example of failure when different users share the tape printing apparatus.
Figure 12C:
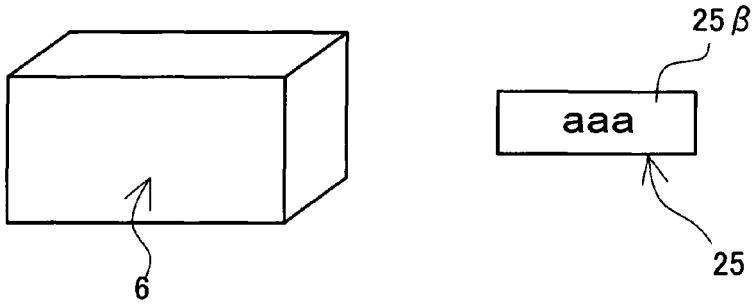
FIG. 12C is a diagram showing an example of failure when different users share the tape printing apparatus.

Consequently, the former user cannot obtain the desired label 25 where the label 25α of the first sheet and the label 25β of the second sheet are uncut, but the label 25 where the label 25α of the former user and the label 25γ of the latter user are uncut, which has been described in PROBLEM TO BE SOLVED BY THE INVENTION as shown in FIG. 12B, can be prevented from being created.

In this point, the former user cannot obtain the desired label 25 where the label 25α of the first sheet and the label 25β of the second sheet are uncut, but even when the desired label where the desired label 25 where the label 25α of the first sheet and the label 25β of the second sheet are uncut can be provided, the former user usually uses the label 25α of the first sheet and the label 25β of the second sheet by cutting off from each other, so that inconvenience situations can be restricted.

Furthermore, in the tape printer 1 of this embodiment, when the power is turned off (S21: YES), the uncut printing in the printer 6 is printed in the auto-cut state (S32), the label 25 where the label 25α of the former user and the label 25γ of the latter user are uncut can be prevented from being created.

The present invention may be embodied in other specific forms without departing from the essential characteristics thereof. For instance, in the tape printer 1 of the embodiment, the predetermined condition is met when the cassette cover 7 of the printer 6 is opened (S25: YES). It can be also determined that the predetermined condition is met at S25 when the cassette cover 7 of the printer 6 is changed from the closed state to the opened state, and the cassette cover 7 of the printer 6 is changed from the opened state to the closed state. In this case, however, in the cover opening/closing motion detection process at S15, change of the detection signal from the cover sensor 101 needs to be stored in the RAM 56 at the timing of the change.

Incidentally, the opening/closing movement of the cassette cover 7 with respect to the printer 6 is performed when the cassette cover 7 is attached to or removed from the printer 6, and when the cassette cover 7 pivotally supported by the printer 6 is turned. The cover sensor 101 can detect both of the opened state and the closed state in both of the cases.

Furthermore, in the tape printer 1 of the embodiment, the entry of the text data to be printed on the print tape 8 with the print mechanism PM, the auto-cut mode, the print command, the on-line/off-line command and the like are performed by the communication through the connecting cord L from the data creating apparatuses 2A, 2B, 2C and more. The printer 6 itself can be also provided with the keyboard to perform the entry of the text data to be printed on the print tape 8 with the print mechanism PM, the auto-cut mode, the print command, the on-line/off-line command and the like.

To achieve that, the process as shown in FIG. 25 is performed at W1 between S23 and S25. To be more specific, if it is determined that there is no data received (S23: NO), the flow advances to S27 to determine whether there is any key entry from the keyboard provided in the printer 6 itself. At this time, if it is determined that there is no key entry from the keyboard provided in the printer 6 itself (S27: NO), the process advances to the above S25 in FIG. 1, whereas if it is determined that there is key entry from the keyboard provided in the printer 6 itself (S27: YES), the process advances to S28 to perform a main body data process in FIG. 6, which will be described later, and then the flow returns to S13 in above-described FIG. 1.

Herein, the main body data process at S28 is explained with reference to FIG. 6. In the main body data process as shown in FIG. 6, first it is determined whether the key entry specified at the above-described S27 is the text entry or not. If it is determined that the key entry specified at the above-described S27 is the text entry (S161: YES), the flow advances to S162 to execute a text editing process of editing the text data to be printed on the label 25 in the RAM 56, and then the main body data process is terminated. On the other hand, if it is determined that the key entry specified at the above-described S27 is not the text entry (S161: NO), the flow advances to S163.

At S163, it is determined whether the key entry specified at the above-described S27 is auto-cut set key or not. Herein, if it is determined that the key entry specified at the above-described S27 is the auto-cut set key (S163: YES), the flow advances to S164 to execute an auto-cut on/off setting process, and then the main body data process is terminated after the mode is stored in the RAM 56. On the other hand, if it is determined that the key entry specified at the above-described S27 is not the auto-cut set key (S163: NO), the flow advances to S165.

At S165, it is determined whether the key entry specified at the above-described S27 is a print key or not. Herein, if it is determined that the key entry specified at the above-described S27 is the print key (S165: YES), the flow advances to S166 to execute the aforementioned print process in FIG. 4, and then the main body data process is terminated. On the other hand, if it is determined that the key entry specified at the above-described S27 is not the print key (S165: NO), the flow advances to S167.

At S167, it is determined whether the key entry specified at the above-described S27 is the on-line/off-line key. Herein, it is determined that the key entry specified at the above-described S27 is the on-line/off-line key (S167: YES), the flow advances to S168 to switch the connecting cord L connected to the input/output interface (input/output I/F) 57 to the off-line state from the on-line state, or to the on-line state from the off-line state, and then the main body data process is terminated. On the other hand, if it is determined that the key entry specified at the above-described S27 is not the on-line/off-line key (S167: NO), the flow advances to S169 to execute other editing processes, and then this main body data process is terminated.

As described above, the label 25 where the label 25α of the one user and the label 25γ of the other user are uncut can also be prevented from being created when the entry of the text data to be printed on the print tape 8 with the print mechanism PM, the auto-cut mode, the print command, the on-line/off-line command and the like are performed in the printer 6 provided with the keyboard.

Further, in the printer 6 of the tape printing apparatus 1 of the embodiment, if interrupt printing and numbering printing are performed, when any one of conditions such as "timeout elapsed", "communication cable removed", "cover opened", "new entry user information detected" and "on/off line switched" is met during the printing (S25: YES), the uncut printing is forcibly cut (S32), the case where the outputs from the different uses are printed uncut can be reduced.

INDUSTRIAL APPLICABILITY

This invention can be applied to a control technology for the case where an uncut-print command and cut-print command are issued from different sources.

The invention claimed is:

1. A printer comprising:

a print data storage unit that stores inputted print data;

a print data printing device that prints the print data stored in the print data storage unit on a printing medium;

a cutter that cuts the printing medium printed by the print data printing device;

a cut-on mode setting device that sets the printer in a cut-on mode so that the cutter is operated after the printing medium is printed by the print data printing device; and a first-cut operation control device that operates the cutter after the printing medium is printed by the print data printing device only when the cut-on mode setting device sets the printer in the cut-on mode, wherein the printer is provided with:

a determination device that determines whether a predetermined condition is met or not; and a second-cut operation control device that, if the determination device determines that the predetermined condition is met, operates the cutter after the printing medium is printed by the print data printing device even when the cut-on mode setting device does not set the printer in the cut-on mode, wherein the printer further comprises:

an entry user information storage unit that stores entry user information which includes a source of entry of the print data; and an identification device that identifies whether or not entry user information newly stored in the entry user information storage unit is different from entry user information last stored in the entry user information storage unit, and wherein the determination device determines that the predetermined condition is met when the identification device identifies the new entry user information as being different from the entry user information last stored in the entry user information storage unit.

2. A printer comprising:

a print data storage unit that stores inputted print data;

a print data printing device that prints the print data stored in the print data storage unit on a printing medium;

a cutter that cuts the printing medium printed by the print data printing device;

a cut-on mode setting device that sets the printer in a cut-on mode so that the cutter is operated after the printing medium is printed by the print data printing device; and a first-cut operation control device that operates the cutter after the printing medium is printed by the print data printing device only when the cut-on mode setting device sets the printer in the cut-on mode, wherein the printer is provided with:

a determination device that determines whether a predetermined condition is met or not;

a second-cut operation control device that, if the determination device determines that the predetermined condition is met, operates the cutter after the printing medium is printed by the print data printing device even when the cut-on mode setting device does not set the printer in the cut-on mode; and a clocking device that measures an elapsed time since the printing medium is last printed by the print data printing device, wherein the determination device determines that the predetermined condition is met when the elapsed time measured by the clocking device exceeds a set period of time.

3. A printer comprising:

a print data storage unit that stores inputted print data;

a print data printing device that prints the print data stored in the print data storage unit on a printing medium;

a cutter that cuts the printing medium printed by the print data printing device;

a cut-on mode setting device that sets the printer in a cut-on mode so that the cutter is operated after the printing medium is printed by the print data printing device; and a first-cut operation control device that operates the cutter after the printing medium is printed by the print data printing device only when the cut-on mode setting device sets the printer in the cut-on mode, wherein the printer is provided with:

a determination device that determines whether a predetermined condition is met or not;

a second-cut operation control device that, if the determination device determines that the predetermined condition is met, operates the cutter after the printing medium is printed by the print data printing device even when the cut-on mode setting device does not set the printer in the cut-on mode; and a cover that is provided in a main body of the printer and is changeable between an opened state for allowing the printing medium printed by the print data printing device to be exposed and a closed state for covering the printing medium, and a cover-state detection device that detects the opened state of the cover, wherein the determination device determines that the predetermined condition is met when the cover-state detection device detects the opened state of the cover.

4. A printer comprising:

a print data storage unit that stores inputted print data;

a print data printing device that prints the print data stored in the print data storage unit on a printing medium;

a cutter that cuts the printing medium printed by the print data printing device;

a cut-on mode setting device that sets the printer in a cut-on mode so that the cutter is operated after the printing medium is printed by the print data printing device; and a first-cut operation control device that operates the cutter after the printing medium is printed by the print data printing device only when the cut-on mode setting device sets the printer in the cut-on mode, wherein the printer is provided with:

a determination device that determines whether a predetermined condition is met or not;

a second-cut operation control device that, if the determination device determines that the predetermined condition is met, operates the cutter after the printing medium is printed by the print data printing device even when the cut-on mode setting device does not set the printer in the cut-on mode;

a connector, to which a cable for transfer of the print data can be removably connected; and a cable detection device that detects whether the cable is inserted in or removed from the connector;

wherein the determination device determines that the predetermined condition is met when the cable detection device detects the removal of the cable from the connector.

5. A printer comprising:

a print data storage unit that stores inputted print data;

a print data printing device that prints the print data stored in the print data storage unit on a printing medium;

a cutter that cuts the printing medium printed by the print data printing device;

a cut-on mode setting device that sets the printer in a cut-on mode so that the cutter is operated after the printing medium is printed by the print data printing device; and a first-cut operation control device that operates the cutter after the printing medium is printed by the print data printing device only when the cut-on mode setting device sets the printer in the cut-on mode, wherein the printer is provided with:

a determination device that determines whether a predetermined condition is met or not;

a second-cut operation control device that, if the determination device determines that the predetermined condition is met, operates the cutter after the printing medium is printed by the print data printing device even when the cut-on mode setting device does not set the printer in the cut-on mode;

a switching device that switches a cable connectable to the printer for transfer of the print data to an on-line state or an off-line state; and a switching operation detection device that detects an operation of the switching device, wherein the determination device determines that the predetermined condition is met when the switching operation detection device detects the operation of the switching device.

* * * * *